United States Patent [19]

Ringsmuth et al.

[11] Patent Number: 4,570,703

[45] Date of Patent: Feb. 18, 1986

[54] TUBE SUPPORT GRID AND SPACER THEREFOR

[75] Inventors: Richard J. Ringsmuth, Solano Beach; Jay S. Kaufman, Del Mar, both of Calif.

[73] Assignee: The United States of America as represented by the United States Department of Energy, Washington, D.C.

[21] Appl. No.: 346,612

[22] Filed: Feb. 8, 1982

[51] Int. Cl.[4] ..... F28F 9/04

[52] U.S. Cl. ..... 165/162; 165/172; 165/178; 248/68.1; 248/DIG. 1

[58] Field of Search ..... 165/158, 160, 162, 172, 165/178; 122/32, 34; 376/405, 438–442, 462; 248/68.1, DIG. 1

[56] References Cited

U.S. PATENT DOCUMENTS

| | | | |
|---|---|---|---|
| 3,055,349 | 9/1962 | Hamilton et al. | 122/510 |
| 3,199,582 | 8/1965 | Vogt et al. | 122/510 |
| 3,267,915 | 6/1965 | De Ghetto et al. | 122/510 |
| 3,277,872 | 10/1966 | Hoffmann et al. | 122/510 |
| 3,637,008 | 1/1972 | Michel et al. | 165/162 |
| 3,646,994 | 3/1972 | Piepers et al. | 165/162 |
| 3,768,448 | 10/1973 | Beckman | 122/510 |
| 3,924,676 | 12/1975 | Bennett | 165/172 |
| 3,989,105 | 11/1976 | Trepaud | 165/158 |
| 4,058,161 | 11/1977 | Trepaud | 165/162 |
| 4,286,654 | 9/1981 | Ruhe | 165/172 |

*Primary Examiner*—Douglas Hart

*Attorney, Agent, or Firm*—Fitch, Even, Tabin & Flannery

[57] ABSTRACT

A tube support grid and spacers therefor provide radially inward preloading of heat exchange tubes to minimize stress upon base welds due to differential thermal expansion. The grid comprises a concentric series of rings and spacers with opposing concave sides for conforming to the tubes and V-shaped ends to provide resilient flexibility. The flexibility aids in assembly and in transmitting seismic vibrations from the tubes to a shroud. The tube support grid may be assembled in place to achieve the desired inwardly radial preloading of the heat exchange tubes. Tab and slot assembly further minimizes stresses in the system. The radii of the grid rings may be preselected to effect the desired radially inward preloading.

12 Claims, 6 Drawing Figures

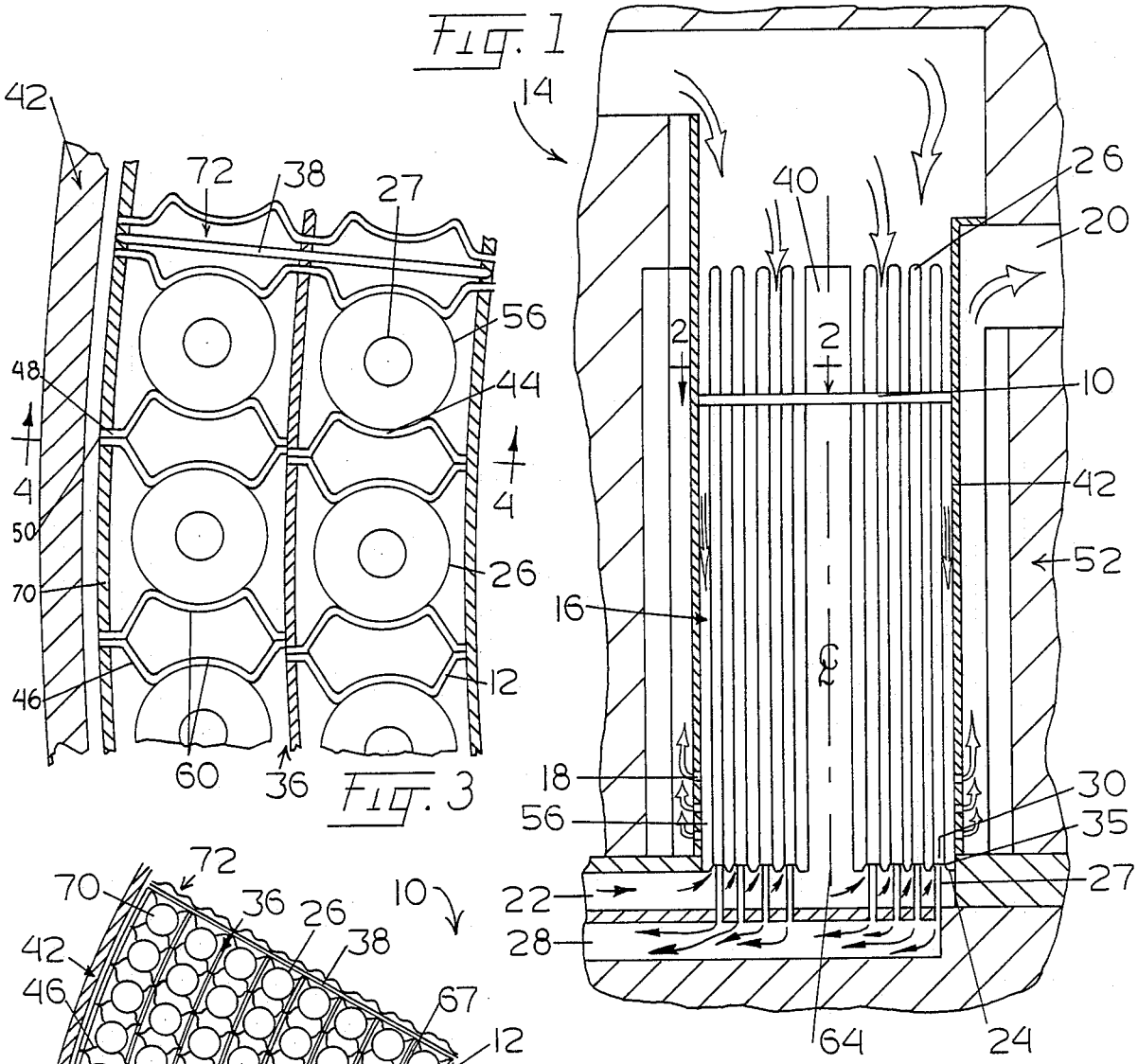
Fig. 1
Fig. 3
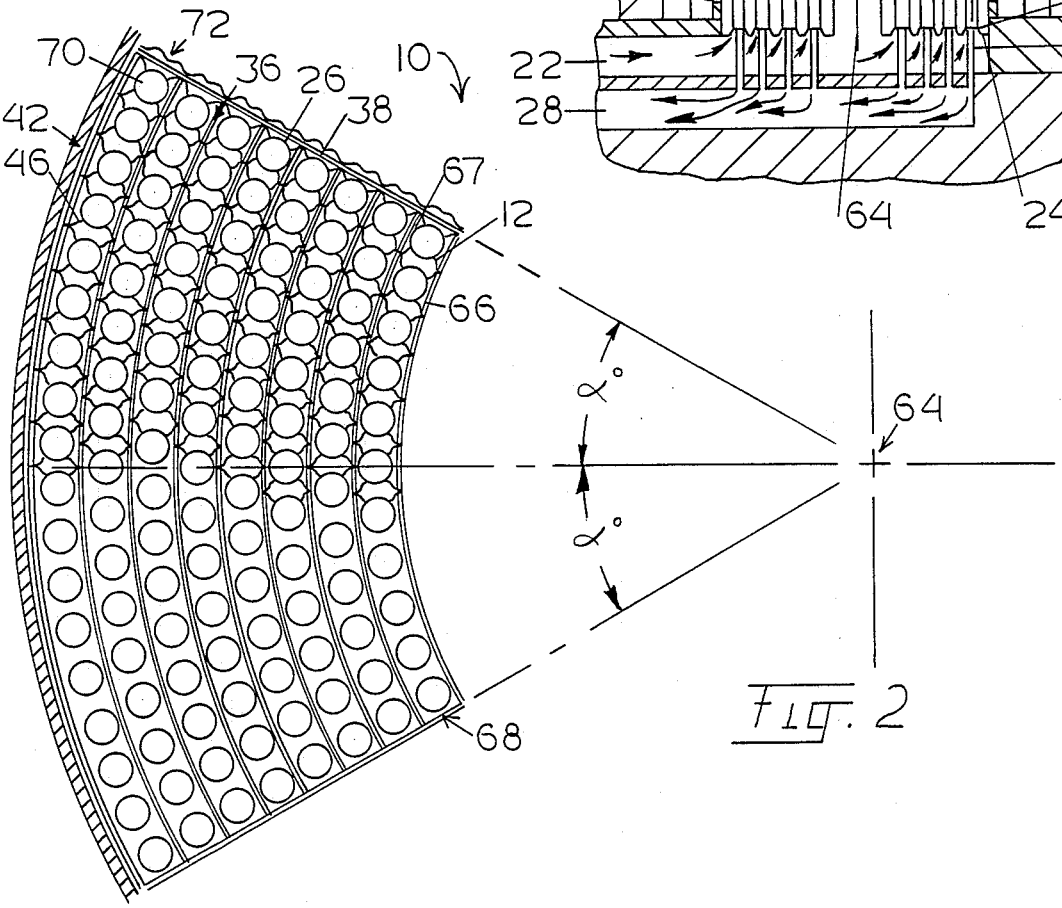
Fig. 2

Fig. 4
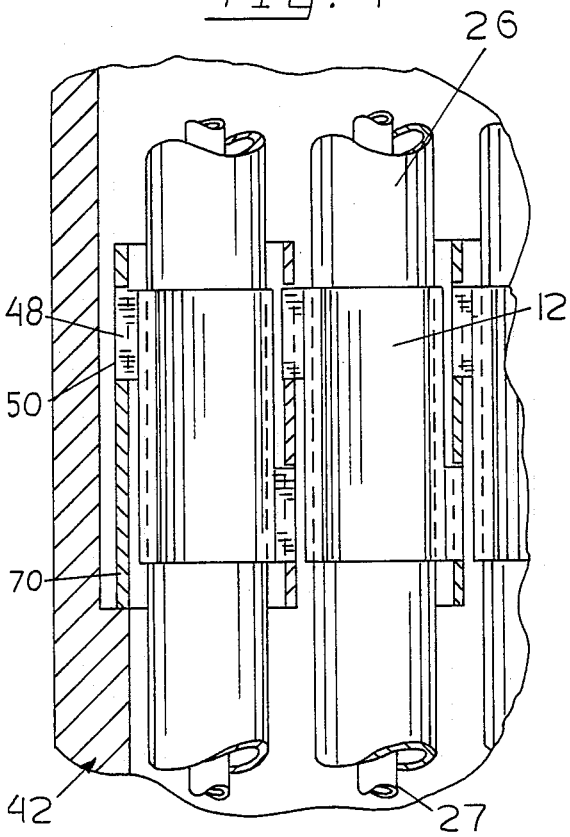
Fig. 6
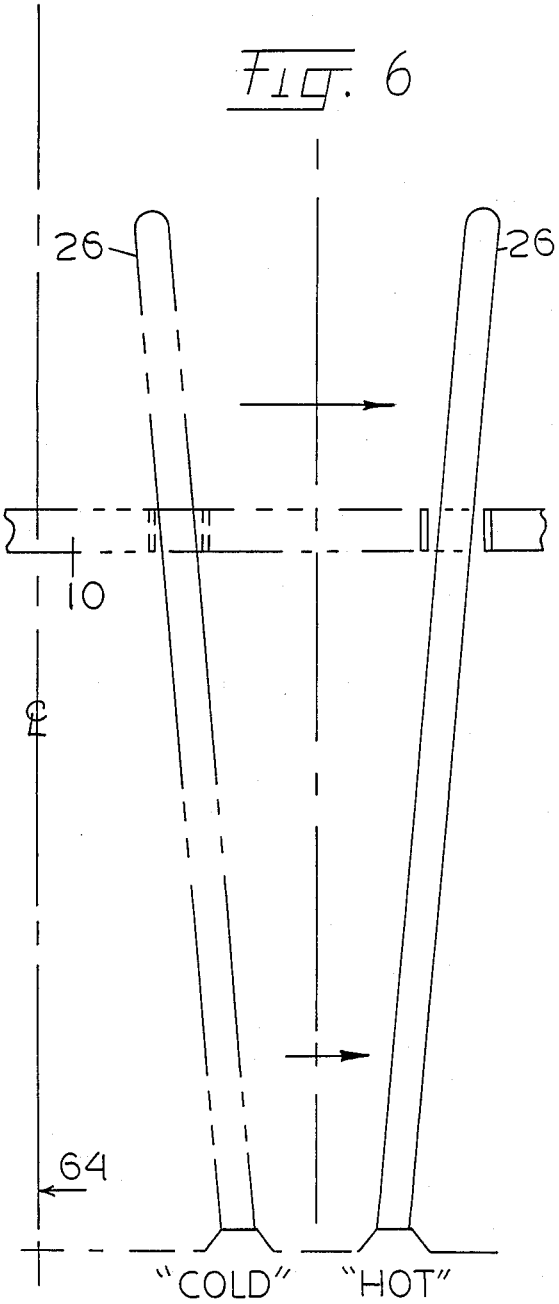
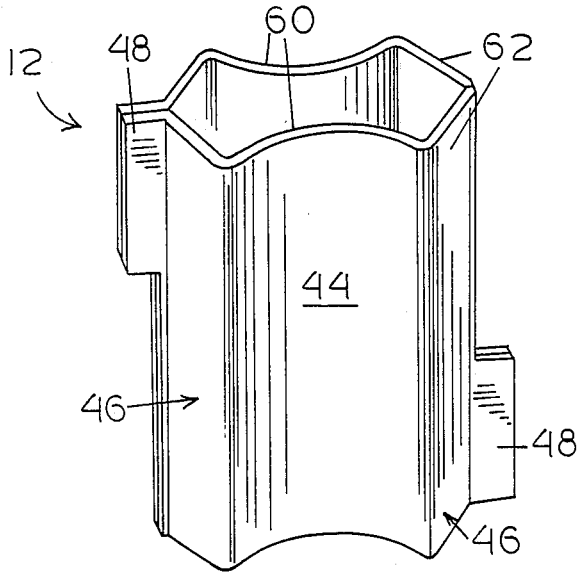
Fig. 5

TUBE SUPPORT GRID AND SPACER THEREFOR

The Government has rights in this invention pursuant to Contract No. DE-AT03-76ET35301 awarded by the U.S. Department of Energy.

BACKGROUND OF THE INVENTION

The present invention relates to a tube support grid and spacers therefor, and has particular application to the design of tube support grids for heat exchangers, especially heat exchangers used in nuclear reactors.

While the present invention is of general applicability, it contemplates a gas/liquid heat exchanger with generally vertically extending heat exchange tubes. A heat exchanger of the type herein considered includes a heat exchange chamber through which superheated helium, or other coolant gas, flows adjacent the outer surfaces of heat exchange tubes. Water, or other liquid coolant, flows within the tubes so as to absorb heat from the helium. The water enters the tubes from a water inlet chamber through a tube sheet to which the tubes are welded.

A tube support grid is often used to support the upper ends of the tubes. Normally, a tube support grid is spaced some distance down from the tops of the tubes. Preferably, the grid provides support for the tubes, maintains appropriate spacing between respective tubes, and provides relief from vibrations which might be generated from seismic or other events.

The temperature differentials in such a heat exchanger can be substantial. These differentials are particularly large in heat exchangers used to dump heat from a reactor core during reactor malfunction. Gas inlet temperatures exceed 1700° F., while water inlet temperatures are generally less than 200° F. These temperature differentials can generate stresses due to differential thermal expansion. In the contemplated heat exchanger, the expansion of the tube sheet is governed primarily by the inlet temperature of the water, while the expansion of the tube support grid is governed primarily by the temperature of the gas. Consequently, the grid tends to expand more than the tube sheet.

Where the tubes are vertical under normal conditions (e.g. at room temperature, or at normal temperatures when the heat exchanger is not in use), differential expansion of the tube sheet and grid causes the tops of the tubes to be forced radially outward relative to their bases. This tilting stresses the base welds. Eventually the stresses will break the welds, perhaps allowing liquid to flow into the exchange chamber with dire effects. Safety and economic considerations require that the stresses on the welds be minimized.

SUMMARY OF THE INVENTION

A tube support grid permits prestressing heat exchange tubes radially inward to minimize the stresses on base welds during operation of a heat exchanger. The grid comprises tube spacers, concentric rings, and means for supporting the concentric rings. Each spacer supports and spaces two immediately adjacent tubes within a respective circular row of the circular array according to which the tubes are arranged. The rings are on a pitch substantially equal to the radial pitch of the circular array. They support and position the spacers.

The spacers have concave sides to conform to the outer surfaces of the heat exchange tubes so that the latter may be positioned and supported by the former. The spacers preferably have V-shaped ends which may be welded to adjacent concentric rings. The shape and material, a sheet metal, are selected so that the spacers can flex resiliently. The flexing compensates for thermal distortions and allows transmission of vibrations from the tubes to a shroud of the heat exchanger, as is desired during seismic events.

The rings are generally cylindrical and alternate with the circular rows of tubes; accordingly, the number of rings is one more than the number of circular rows of tubes. The rings support and position the spacers so that every tube is supported and contacted by two spacers.

The grid may be assembled in place. The rings are positioned within the heat exchanger one at a time, from smallest to largest. Between the times at which any two adjacent rings are positioned, the tubes of the row between the rings are positioned, welded, and deflected inwardly. Temporary means are provided to maintain the deflection of the tubes while the spacers are inserted, the outer of the adjacent rings is positioned, and the spacers welded to the adjacent rings. The inward preloading is maintained by the tube support grid after the removal of the temporary means.

Preferably, the spacers and rings respectively include tabs and slots so as to provide more assured assembly. During assembly, the extension of tabs into slots can be adjusted to minimize undesired stresses. Once the adjustments are made, the tabs may be welded into the slots to secure the spacers and rings.

In accordance with one aspect of the present invention, the radii of the rings may be selected so that the tops of the tubes are forced inward a predetermined amount at room temperature. This amount is preferably between that calculated to minimize the maximal deflection from the vertical over the expected temperature ranges of the heat exchanger and that calculated to minimize deflection from the vertical at maximum operating temperatures of the heat exchanger. As a result of this inward preloading, stressing of welds at the base of the tubes is minimized, enhancing the economy and longevity of the heat exchanger and the safety of an incorporating nuclear reactor.

BRIEF DESCRIPTION OF THE DRAWINGS

FIG. 1 is a vertical sectional view of a heat exchanger to which the present invention applies.

FIG. 2 is a sectional view of a section of an tube support grid in accordance with the present invention.

FIG. 3 is an enlarged view of a portion the tube support grid shown in FIG. 2.

FIG. 4 is a sectional view of the tube support grid shown in FIG. 3 taken along line 4—4.

FIG. 5 is a perspective view of the spacer shown in FIG. 4.

FIG. 6 is a diagrammatic illustration of a heat exchange tube before and after thermal expansion of a tube sheet and a tube support grid.

DESCRIPTION OF THE PREFERRED EMBODIMENTS

A tube support grid 10 and spacers 12 therefor are incorporated in a heat exchanger 14, shown in FIG. 1, such as might be used to dump heat from a nuclear core during reactor malfunction. Hot helium, or other gaseous primary coolant, flows downwardly through an exchange chamber 16, through openings 18 near the base of the exchange chamber 16 and through a gas outlet 20. Water, or other liquid secondary coolant, flows into a water inlet chamber 22, through a tubesheet 24, up and down the heat exchange tubes 26 and through a water outlet chamber 28. The heat exchange tubes 26 are welded at their bases 30 to the tube sheet 24 and extend generally vertically through the exchange chamber 16. The tubes 26 are supported along their upper portions by the tube support grid 10. Heat is transferred from the helium through the walls of the heat exchange tubes 26 to the water therein. In this manner, the heat of the helium is dumped by the heat exchanger 14.

An inherent problem in such a heat exchanger is the differential thermal expansion of the grid 10 relative to the tube sheet 24. The grid 10 is primarily exposed to the superheated helium, and expands accordingly. The upper surface of the tube sheet 24 may be exposed to the helium, but the lower surface is exposed to inlet water coolant. The heat capacity of water is far greater than that of helium, so the water is the primary factor in determining the temperature and, hence, the expansion of the tube sheet 24. Since the water temperature range is substantially lower than the helium temperature range, the tube support grid 10 typically expands more than the tube sheet 24 as the heat exchanger 14 begins to operate. The greater thermal expansion of the tube support grid 10 forces the upper portions of the tubes 26 radially outward relative to their bases 30, stressing the base welds. The stressing may weaken the bond between the tube 26 and tube sheet 24 and/or fracture a weld so as to permit water to enter the exchange chamber 16, greatly limiting the effectiveness of the heat transfer and permitting corrosive steam to pervade the components of the heat transfer system.

The tube support grid 10 of the present invention comprises tube spacers 12, concentric cylindrical rings 36 and means supporting the rings 36. The spacers 12 are designed to be flexible and to conform to adjacent tubes 26. The rings 36 position and support the spacers 12 and are in turn supported by means, such as radial bars 38 extending from a center post 40 to an inner shrouding 42 of the heat exchanger 14.

The radii of the rings 36 may be selected so that the tubes 26 are forced radially inward of their vertical equilibrium position at non-operating or room temperature. In a first preferred embodiment, the extent of the radially inward displacement from the vertical at "cold" temperatures (thermal equilibrium under non-operating conditions) is equal to an expected radially outward displacement from the vertical due to the differential expansion of the tube sheet 24 and support grid 10 at the "hot" operating temperatures of the heat exchanger 14. This selection minimizes the maximum deflection from the vertical, thereby minimizing stresses at the welded bases 30 of the tubes 26. In a second preferred embodiment, the extent of the radially inward displacement of the tubes at cold temperatures is selected so that there is negligible deflection from the vertical at hot temperatures. Intermediate extents of radially inward preloading are also preferred.

The spacers 12 have concave sides 44 to conform and contact the outer surfaces of adjacent heat exchange tubes 26. The concave sides 44 in conjuntion with V-shaped ends 46 directed away from one another provide a resiliently flexible structure capable of supporting and spacing the tubes 26 while being able to transmit vibrations from the tubes to the shroud 42 and distribute stresses during exchanger assembly and operation.

In accordance with the preferred embodiments of the present invention, the spacers 12 have radially directed tabs 48 for insertion into slots 50 in the rings 36. The slots 50 fix the positions of the spacers 12 and provide for secure welding of the spacers 12 to the rings 36. Additionally, the extension of the tabs 48 into the slots 50 may be adjusted prior to welding so that distorting stresses may be distributed and minimized during assembly of the grid 10.

Describing the preferred embodiment and its environment in greater detail, the heat exchanger 14, shown in FIG. 1, includes a plurality of heat exchange tubes 26 welded at their bases 30 to a tube sheet 24 and supported and spaced toward their tops by a tube support grid 10. Helium, or other gaseous primary coolant, flows downwardly through the heat exchange chamber 16, and exits the chamber 16 through openings 18 near the bottom of the inner shrouding 42. The helium then proceeds upward between the inner and outer shroudings 42 and 52 to the helium outlet 20, whence it is recirculated to the reactor core. Providing an outer shrouding 52 and directing helium between it and the inner shrouding 42 reduces the temperature gradient across the inner shrouding 42, thereby limiting its distortion. The overall height of the illustrated heat exchanger 14 is about 255". The exchange chamber 16 is circularly cylindrical; its height is about 171", and its diameter is about 71".

Water, or other liquid secondary coolant, flows up an outermost space between an outer wall of each tube 26 and an inner tube 27. The water flows down from the top of the tube 26 through the inner tube 27, which extends to the water outlet chamber 28. Each tube 26 has an active length, e.g. within the exchange chamber 16, of about 168", and an outer radius of 1.375".

The tubes 26 may be arranged in a circular array as shown in FIG. 2. The illustrated embodiment has 696 tubes arranged with their bases 30 in a circular array with a cold radial pitch of 1.8750" and a cold circumferential pitch of 1.9635". The innermost circular row 68 of tubes 26 in the array has 66 tubes, the tube count of the circular rows increases by sixes so that the eighth and outermost circular row 72 has 108 tubes. A center post 40 is provided for structural support of the exchanger 14 and grid 10 and to maintain the helium flow among the tubes 26.

The outer walls 56 of the heat exchange tubes 26 are welded at their bases 30 to the tube sheet 24. The tube sheet 24 may have a circular array of hollow nipples 35 to facilitate placement of the tubes 26 and to provide additional surface area for the welds. Of course, the dimensions of the array of nipples 35 are equal to those of the array of tube bases 30.

The heat exchange tubes 26 are supported about 55" below their tops, about two-thirds up their active length, by the tube support grid 10. The tube support grid 10 itself is supported by means comprising six radial bars 38 extending from the center post 40 to the inner shrouding 42. The grid 10 includes the concentric series of rings 36, each ring 36 having downwardly facing slots (not shown) for engaging the radial bars 38. This arrangement allows relative radial movement of the bars 38 and the rings 36 during thermal expansion, thereby lessening opportunities for distorting stresses to accumulate. Since the grid 10 is spaced downward from the top of the exchanger, it is exposed to helium which has already been cooled to about 1300° F.; however, this is substantially higher than the 200° F. temperature that the tube sheet achieves.

The rings 36 support the attached spacers 12. A spacer 12 of the preferred embodiment has two opposing concave sides 44. The radius of curvature of the outside surface of each concave side 44 is approximately equal to the common outer radii of the heat exchange tubes 26 so as to conform thereto upon engagement. Preferably, each concave side 44 subtends one-fourth of a circle to optimize support and ease of grid assembly. The waist 60 of the spacer 12, where the concave sides 44 achieve their closest mutual approach, has a width approximately equal to the difference between the circumferential pitch of the circular row and twice the common radius of the tubes 26. The spacer 12 also has two radially aligned V-shaped ends 46 directed away from one another. Each end 46 is connected to both of the concave sides 44. The resulting shape provides resilient flexibility so as to accommodate and distribute the inevitable stresses of heat exchanger operation. The spacers 12 may be formed from two stamped pieces of sheet metal 62 welded together.

Preferably, the spacers 12 have radially extending tabs 48 for insertion into slots 50 formed in the rings 36. The slots 50 must be arranged in respective rings 36 adjacent a given circular row of tubes 26 so that the spacers 12 are located midway between immediately adjacent tubes 26 within the given circular row. In other words, each pair of immediately adjacent tubes 26 within a given circular row defines two slots 50, one slot in the ring 36 immediately radially inward of the circular row, and one slot in the ring 36 immediately radially outward of the circular row. Both of these slots 50 lie on a line bisecting a planar angle with its vertex along the axis 64 of the heat exchanger 14, the planar angle being defined by planes extending through the axis of each of the two tubes and the axis of the heat exchanger 14. The spacers 12 are thus securely positioned between pairs of tubes 26, supporting and spacing each tube 26 of each of the pairs.

The tab and slot system has the advantage of allowing variable extension of the tab 48 through the slot 50 during assembly. This extension may be adjusted prior to welding to allow stresses on the tubes to be equalized and distributed during assembly, providing for more ready manufacture and a more predictable final product.

The tabs 48 may be offset as shown in FIG. 4 so that the rings 36 with two rows of slots 50 (all but the innermost ring 66 and the outermost ring 70) can be formed without regard to interference of one row with the other. In the illustrated embodiment, the rings 36 are 4" high, the spacer 12 are 3" high, and the tabs 48, which are located at opposite vertical extremes of the two ends of the spacer 12, are 1" high.

Although the spacers 12 are flexible, it is preferable to select a radial extent for the spacers 12 which corresponds to the pitch of the concentric series of rings 36. The preferred pitch, and more particularly, the preferred radii of the rings 36 are chosen so as to minimize stresses on the base welds.

There are a range of preferred approaches to determining the extent of radially inward preloading. At one extreme the objective is to minimize the maximal deflection of the heat exchange tubes 26. This approach is derived from the assumption that the stress on a base weld is proportional to the deflection from the vertical. By minimizing the maximal deflection from the vertical, the maximal stresses are also minimized. At the other extreme, the objective is to achieve negligible deviation from the vertical under operating conditions. This approach is derived from the assumption that the most serious deterioration of the welds is likely to occur at maximum temperatures; thus, it is desirable to minimize the stress on a weld a maximum temperatures. Intermediate approaches are also considered preferred.

The first preferred embodiment incorporates the objective of minimizing the maximal deflection of the heat exchange tubes 26. This is accomplished by selecting rings 36 with cold radii such that the radially inward deflection of the tubes 26 under cold conditions equals the radially outward deflection under hot conditions, as shown in FIG. 6.

The desired radii of the rings 36 may be calculated as follows. Determine the temperature range to which the tube sheet is to be exposed and the mean linear coefficient of thermal expansion over that temperature range for the material of the tube sheet. Multiply the mean coefficent of expansion by the difference between the hot and cold temperatures of the range. Add 1 to obtain the expansion factor for the tube sheet; "expansion factor" is used herein to mean the factor by which an object radially expands over the temperature range to which it is exposed.

Determine the temperature range to which the grid 10 is to be exposed and the mean coefficient of the expansion over that temperature range for the material of the grid 10. Multiply the mean coefficent of expansion by the difference between the hot and cold temperature of the range. Add 1 to obtain the expansion factor for the grid 10.

Given the known cold radii of the rows of tube bases 30 arranged in a regular circular array with constant and known cold radial and circumferential pitches, calculate the hot radii of the circular rows of tube bases 30 by multiplying each radius by the expansion factor of the tube sheet. For each circular row of tube bases 30, add the hot and the cold radii and divide this sum by one plus the expansion factor for the grid 10; this gives the desired cold radius of the corresponding circular row of tubes 26 at the level of the support grid 10. Subtract the desired cold radius of the innermost circular row 68 of tubes 26 at the level of the support grid 10 from the desired cold radius of the outermost circular row 72 of tubes 26 at the level of the support grid 10 and divide this difference by one less than the number of circular rows of tubes 26 to obtain the desired cold radial pitch of the tubes 26 at the level of the support grid 10; this is nominally equivalent to the desired cold radial pitch for the tube support rings 36.

Subtract one-half of the desired cold radial pitch for the rings 36 from the desired cold radius of the innermost circular row 68 of tubes 26 at the level of the grid 10 to obtain the desired cold radius of the innermost ring 66. Where "m" equals the number of rings 36 a given ring is beyond the innermost ring 66, the sum of the desired cold radius of the innermost ring 66 and the product of m by the desired cold radial pitch of the rings 36 renders the desired cold radius of that given ring. Where "n" is the number of circular rows of tubes 26 in the array, iterative calculations with m ranging from zero to n renders the desired cold radii for all of the rings 36.

More succinctly, $$R_{rm} = [(m - 0.5)P_t + R_{t1}] \times \frac{[2 + C_t(T_{th} - T_{tc})]}{[2 + C_r(T_{rh} - T_{rc})]}$$

where $R_{rm}$ is the desired cold radius of the mth ring, where m is between zero and n, n being the number of circular rows of tubes 26;

$P_t$ is the cold radial pitch of the tube bases 30 of the tube sheet;

$C_t$ is the mean linear thermal coefficient of expansion of the tube sheet over the range of temperatures it is expected to achieve;

$T_{th}$ is the expected maximum ("hot") temperature which the tube sheet is expected to achieve;

$T_{tc}$ is the expected minimum ("cold") temperature which the tube sheet is expected to achieve;

$R_{t1}$ is the cold radius of the innermost circular row of tube bases 30;

$C_r$ is the mean linear thermal coefficient of expansion of the grid 10 over the range of temperatures it is expected to achieve;

$T_{rh}$ is the expected maximum ("hot") temperature which the grid 10 is expected to achieve; and $T_{rc}$ is the expected minimum ("cold") temperature which the grid 10 is expected to achieve.

This equation may be simplified by expressing the radii in terms of expansion factors rather than thermal coefficients:

$$R_{rm} = [(m - 0.5)P_t + R_{t1}] \times \frac{(1 + E_t)}{(1 + E_g)}$$

where $E_t$ is the expansion factor for the tube sheet over its expected temperature range; and $E_g$ is the expansion factor for the grid 10 over its expected temperature range.

In the first preferred embodiment, the tube sheet is of an alloy known as SA-336 Gr F22a (2.25 Cr, 1 Mo), which has a mean linear thermal coefficient of expansion of $6.38 \times 10^{-6}$ in/in/° F. over the expected temperature range of 70° F. to 200° F. The grid 10 is of SB-409 Grl (Inco 800H), which has a mean linear thermal coefficient of expansion of $9.12 \times 10^{-6}$ in/in/° F. over the expected temperature range of 70° F. to 1300° F. The tube bases 30 of the tubes are arranged in a circular array with eight circular rows, a cold radial pitch of 1.875 and a cold circumferential pitch of 1.964; The innermost circular row of tube bases 30 has a cold radius of 20.625". The desired and expected dimensions can be calculated as indicated above. The results of these calculations are presented in TABLE I, which gives hot and cold dimensions in inches.

The calculations may be confirmed by comparing hot and cold deflections. The cold radius of the innermost circular row of bases 30 is 20.625", and the cold radius of the innermost row 68 of tubes 26 at grid level (which is the average of the cold radii of the two adjacent rings 36) is 20.518"; subtracting, one obtains a radially inward deflection of 0.107". This is equal in magnitude to the radially outward deflection of the innermost row, which is the difference between the hot radius of the innermost circular row 68 of tubes 26 at grid level 20.749" and the hot radius of the innermost circular row of tube bases 30 20.642".

In the first preferred embodiment, the shroud is of the same material as the grid 10, but is subjected to somewhat lower temperatures because one of its surfaces is exposed to outlet gas. The mean linear thermal coefficient of expansion for the shroud is $9.10 \times 10^{-6}$ over the expected temperature range of 70° F. to 1250° F. In order to provide approximately 1/16" clearance between the outermost ring 70 and the shroud at both cold and hot temperatures, a cold inner radius of 34.590 is selected.

In the second preferred embodiment, a greater inward radial preloading is required so that at the hot temperatures there is negligible deflection from the vertical. The desired cold radii of the grid rings 36 may be calculated as follows. The expansions factors for the grid 10 and tube sheet are calculated as for the first preferred embodiment. The desired hot radii of the tubes 26 at grid level are equal to the expected hot radii of the respective circular rows of tube bases 30. The desired cold radii of each circular row of tubes 26 at grid level may be calculated by dividing the desired corresponding hot radius by the expansion factor for the grid 10. The desired cold radial pitch of the circular rows of tubes 26 at grid level is product of the difference between the desired cold radius of the outermost row 72 and the desired cold radius of the innermost row 68 and the reciprocal of the number of circular rows minus one. The desired cold radii of the rings 36 can be calculated from the desired cold radii of the innermost circular row 68 of the tubes 26 and the desired cold radial pitch of the tubes 26 at grid level as shown above with respect to the first preferred embodiment.

TABLE I

COLD/HOT DIMENSIONS IN INCHES OF GRID RINGS AND OF CIRCULAR ARRAYS OF TUBES TO MINIMIZE MAXIMAL DEFLECTION

| | Tubes at Bases | Grid Rings | Tubes at Grid |
|---|---|---|---|
| Ring 0 | | 19.586/19.806 | |
| 1st row | 20.625/20.642 | | 20.518/20.749 |
| Ring 1 | | 21.451/21.692 | |
| 2nd row | 22.500/22.519 | | 22.384/22.635 |
| Ring 2 | | 23.316/23.578 | |
| 3rd row | 24.375/24.395 | | 24.249/24.521 |
| Ring 3 | | 25.182/25.464 | |
| 4th row | 26.250/26.272 | | 26.114/26.407 |
| Ring 4 | | 27.047/27.350 | |
| 5th row | 28.125/28.148 | | 27.980/28.294 |
| Ring 5 | | 28.912/29.237 | |
| 6th row | 30.000/30.026 | | 29.845/30.180 |
| Ring 6 | | 30.778/31.123 | |
| 7th row | 31.875/31.901 | | 31.710/32.066 |
| Ring 7 | | 32.643/33.009 | |
| 8th row | 33.750/33.778 | | 33.576/33.952 |
| Ring 8 | | 34.508/34.895 | |
| Radial pitch | 1.875/1.877 | | 1.865/1.886 |
| Circumferential pitch | 1.963/1.965 | | 1.953/1.975 |
| Shroud | | 34.589/34.960 | |

TABLE II

COLD/HOT DIMENSIONS IN INCHES OF GRID RINGS AND OF CIRCULAR ARRAYS OF TUBES TO MINIMIZE HOT VERTICAL DEFLECTION

| | Tubes at Bases | Grid Rings | Tubes at Grid |
|---|---|---|---|
| Ring 0 | | 19.485/19.704 | |
| 1st row | 20.625/20.642 | | 20.413/20.642 |
| Ring 1 | | 21.341/21.580 | |
| 2nd row | 22.500/22.519 | | 22.269/22.519 |
| Ring 2 | | 23.197/23.457 | |
| 3rd row | 24.375/24.395 | | 24.125/24.395 |
| Ring 3 | | 25.052/25.333 | |
| 4th row | 26.250/26.272 | | 25.980/26.272 |
| Ring 4 | | 27.908/27.210 | |
| 5th row | 28.125/28.148 | | 27.836/28.148 |

TABLE II-continued

COLD/HOT DIMENSIONS IN INCHES OF GRID RINGS AND OF CIRCULAR ARRAYS OF TUBES TO MINIMIZE HOT VERTICAL DEFLECTION

| | Tubes at Bases | Grid Rings | Tubes at Grid |
|---|---|---|---|
| Ring 5 | | 28.764/29.087 | |
| 6th row | 30.000/30.025 | | 29.692/30.025 |
| Ring 6 | | 30.620/30.963 | |
| 7th row | 31.875/31.901 | | 31.548/31.901 |
| Ring 7 | | 32.475/32.840 | |
| 8th row | 33.750/33.778 | | 33.403/33.778 |
| Ring 8 | | 34.331/34.716 | |
| Radial pitch | 1.875/1.877 | | 1.856/1.877 |
| Circumferential pitch | 1.963/1.965 | | 1.943/1.975 |
| Shroud | | 34.034/34.440 | |

The formula for the cold radii of the rings 36 in accordance with the second preferred embodiment is:

$$R_{rm} = [(m - 0.5)P_t + R_{t1}] \times \frac{[1 + C_t(T_{th} - T_{tc})]}{[1 + C_r(T_{rh} - T_{rc})]}.$$

Expressed in terms of expansion factors this becomes:

$$R_{rm} = [(m - 0.5)P_t + R_{t1}] \times \frac{(1 + E_t)}{(1 + E_g)}.$$

Given the temperature ranges, mean coefficients of expansion, and the dimensions of the tube support grid 10 as in the first preferred embodiment, the various expected and desired values may be calculated in accordance with the above formulations. The results of these calculations are presented in TABLE II. The calculations may be confirmed by noting that the average expected hot radii of adjacent rings 36, which equals the expected hot radius of the straddled circular row of tubes 26 at grid level, is also equal to the expected hot radius of the corresponding circular row of tube bases 30 on the tube sheet. The material and dimensions of the shroud of the second preferred embodiment are the same as those for the first preferred embodiment. Appropriate clearance may be provided by constructing the shroud with a cold inner radius of 34.053", which would thus have an expected hot inner radius of 34.400".

The first and second preferred embodiments define approximate boundaries of a range of preferred embodiments. Thus in accordance with the present invention, each ring 36 may have a cold radius from about that calculated in the second preferred embodiment to about that calculated in the first preferred embodiment.

The tube support grid 10 may be assembled in place in accordance with the following method. The innermost ring 66 is positioned at the appropriate level and centered upon the axis of the circular array, which is the same as the axis 64 of the heat exchange chamber 16 in the illustrated embodiment. The grid 10 is supported by the radial bars 38 extending from the center post 40 to the inner shroud 42. The tubes 26 of the innermost circular row 68 are then inserted into the respective nipples 35 and the bases 30 of the tubes 26 are welded into the nipples 35 while the tubes extend vertically therefrom.

The tubes 26 are then deflected radially inward a predetermined amount calculated as disclosed above. The deflecting may be effected by means of a large ring clamp or band placed around the row of tubes. Preferably, the band is located near and below grid level, although the band could also be positioned near the tops of the tubes. The band is gradually tightened until the desired degree of preloading is achieved. Means are then provided to maintain the deflected position of the tubes until this function can be served by the grid 10 itself. The temporary means may involve locking the band when the desired position of the tubes is achieved.

Spacers 12 are then inserted between adjacent pairs of tubes 26 within the innermost row 68. The spacers 12 may be snapped in radially or inserted from above. The radially inward tab 48 of each spacer 12 is inserted into its respective slot 50 in the innermost ring 66 and welded therein. The next largest ring 67 is then positioned with the radially outward tabs 48 of the spacers 12 inserted into the respective slots 50 of the larger ring 67. The extension of the tabs 48 into the slots 50 of the larger ring 67 may be adjusted to minimize stresses distorting the spacers 12. The radially outward tabs 48 are then welded into place. The temporary means maintaining the deflection of the tubes of the innermost row 68 may be removed at this point. Alternatively, the temporary means may be removed along with the corresponding temporary means associated with successive rows of tubes after the outermost ring 70 is positioned and spacers 12 are welded thereto. Successive rings 36, rows of tubes 26, and spacers 12 are assembled sequentially in like manner.

Thus, pursuant to the above, a tube support grid, a spacer therefor, and a method for assembling the grid within a heat exchanger presented. The tube support grid provides support to cylindrical tubes, transmits and distributes stress. The grid also allows ready assembly of a heat exchanger in which stresses on base welds of heat exchange tubes may be minimized. The preferred embodiments presented above, variations thereupon, and other embodiments are within the scope and spirit of the present invention.

What is claimed is:

1. A tube support grid for supporting and spacing heat exchange tubes within a heat exchanger, said heat exchanger being characterized by expected temperature ranges according to location within said heat exchanger, each heat exchange tube having both a coolant inlet and a coolant outlet adjacent its base and being welded at the base to a tube sheet and extending generally upward therefrom, said heat exchanger having a predetermined location a predetermined distance above said tube sheet for said tube support grid, said tubes being arranged on a circular array with a predetermined number of circular rows, said bases of said tubes being arranged in a similar array, the radial and circumferential pitches of which vary within known limits according to the temperature of the tube sheet, said grid comprising:

a series of concentric rings;

means supporting said rings within said heat exchanger; and a plurality of spacers, each spacer spacing an immediately adjacent pair of said rings, each spacer spacing immediately adjacent said tubes within a respective one of said circular rows;

said rings being sized for preloading said tubes by deflecting them when cool inwardly from their as-welded condition with the radii of said rings when cool being substantially between the radii calculated to result in negligible deflection from the vertical of the tubes during maximal operating temperatures and the radii calculated to result in minimal maximum deflection from the vertical over the range of temperatures expected in said heat exchanger.

2. A tube support grid for supporting and spacing heat exchange tubes within a heat exchanger, said heat exchanger being characterized by expected temperature ranges according to location within said heat exchanger, each heat exchange tube having both a coolant inlet and a coolant outlet adjacent its base and being welded at the base to a tube sheet and extending generally upward therefrom, said heat exchanger having a predetermined location a predetermined distance above said tube sheet for said tube support grid, said tubes being arranged on a circular array with a predetermined number of circular rows, said bases of said tubes being arranged in a similar array, the radial and circumferential pitches of which vary within known limits according to the temperature of the tube sheet, said grid comprising:

a series of concentric rings;

means supporting said rings within said heat exchanger; and a plurality of spacers, each spacer spacing an immediately adjacent pair of said rings, each spacer spacing immediately adjacent said tubes within a respective one of said circular rows;

said rings being sized for preloading said tubes by deflecting them when cool inwardly from their as-welded condition with the radii of said rings when cool being approximately the radii calculated to result in negligible deflection from the vertical of the tubes during maximal operating temperatures of said heat exchanger.

3. A tube support grid for supporting and spacing heat exchange tubes within a heat exchanger, said heat exchanger being characterized by expected temperature ranges according to location within said heat exchanger, each heat exchange tube having both a coolant inlet and a coolant outlet adjacent its base and being welded at the base to a tube sheet and extending generally upward therefrom, said heat exchanger having a predetermined location a predetermined distance above said tube sheet for said tube support grid, said tubes being arranged on a circular array with a predetermined number of circular rows, said bases of said tubes being arranged in a similar array, the radial and circumferential pitches of which vary within known limits according to the temperature of the tube sheet, said grid comprising:

a series of concentric rings;

means supporting said rings within said heat exchanger; and a plurality of spacers, each spacer spacing an immediately adjacent pair of said rings, each spacer spacing immediately adjacent said tubes within a respective one of said circular rows;

said rings being sized for preloading said tubes by deflecting them when cool inwardly from their as-welded condition with the radii of said rings when cool being approximately the radii calculated to result in minimal maximum deflection from the vertical over the range of temperatures expected in said heat exchanger.

4. The grid of claim 1, 2, or 3 further characterized in that the number of rings is one more than said predetermined number of said rows of said tubes.

5. The grid of claim 1, 2, or 3 further characterized in that each of said spacers is formed of spring sheet metal to have opposing concave sides and two V-shaped ends pointed away from one another, each of said V-shaped ends contacting both of said concave sides, the outer surface of the concave sides having a radius of curvature approximately equal to that of the outer surface of the tubes so as to conform thereto, the distance of closest approach of said concave sides being approximately equal to the difference between said predetermined circumferential pitch and the diameter of said tubes, each of said ends being bonded to a respective adjacent one of said rings, said spacers being arranged in a circular array with circumferential and radial pitches equal to those of the array of tubes, said array of spacers being offset by one-half the circumferential pitch from said array of tubes so as to space said tubes.

6. The tube support grid of claim 5 further characterized in that each pair of immediately adjacent said tubes within a given circular row of said array defines the location of a slot within each of the two immediately adjacent rings, said location being the intersection of one of said rings and a radius bisecting the planar angle with a vertex along the axis of the array and defined by the axes of the respective of said immediately adjacent said tubes, and in that each of said spacers has tabs directed radially away from one another and connected to a respective one of said ends of said spacer elements, each spacer being positioned between a respective pair of immediately adjacent tubes within a circular row of said array of tubes, said tabs of each said spacer element being inserted into said slots in said locations within each of said immediately adjacent rings defined by said immediately adjacent tubes so as to fix the position of each said spacer element between the respective immediately adjacent rings, said spacers thereby supporting and spacing said tubes within said circular array.

7. A tube support grid for supporting and spacing generally vertically extending tubes arranged in a circular array having predetermined circular and radial pitches, said array having an innermost circular row of tubes with a predetermined radius and a predetermined number of circular rows of tubes, said grid comprising:

a series of concentric rings, the number of rings being one more than the number of circular rows of tubes, the radius of the innermost of said rings being approximately equal to the difference between the radius of said innermost circular row of tubes and one-half the radial pitch of said circular array, said series of concentric rings having a radial pitch approximately equal to that of said circular array;

means spacing and supporting said rings; and a plurality of spacers formed of sheet metal to have opposing concave sides and two V-shaped ends pointed away from one another, each of said ends connecting to both of said concave sides, the outer surface of the concave sides having a radius of curvature approximately equal to that of the outer surface of the tubes so as to conform thereto, the distance of closest approach of said concave sides of each spacer being approximately equal to the difference between said predetermined circumferential pitch and the diameter of said tubes, each of said ends being bonded to a respective adjacent one of said rings, said spacers being arranged in a circular array with circumferential and radial pitches approximately equal to those of the array of tubes, said array of spacers being offset by one-half the circumferential pitch from said array of tubes so as to space said tubes.

8. A tube support grid for supporting and spacing generally vertically extending tubes arranged in a circular array having predetermined circumferential and radial pitches said array having an innermost circular row of tubes with a predetermined radius and a predetermined number of circular rows of tubes, said grid comprising:

a series of concentric rings, the number of rings being one more than the number of circular rows of tubes, the radius of the innermost of said rings being approximately equal to the difference between the radius of said innermost circular row of tubes and one-half the radial pitch of said circular array, said series of concentric rings having a radial pitch approximately equal to that of said circular array, each pair of immediately adjacent said tubes within a given circular row defining the location of a slot within each of the two immediately adjacent rings, said location being the intersection of one of said rings and a radius bisecting the planar angle with a vertex along the axis of the array defined by the axes of the respective ones of said immediately adjacent tubes;

means spacing and supporting said rings; and a plurality of spacers formed of sheet spring metal to have opposing concave sides and two V-shaped ends pointed away from one another, each of said ends connecting to both of said concave sides, the outer surface of the concave sides having a radius of curvature approximately equal to that of the outer surface of the tubes so as to conform thereto, the distance of closest approach of said concave sides of each spacer being approximately equal to the difference between said predetermined circumferential pitch and the diameter of said tubes, each of said spacers having tabs directed radially away from one another and connected to a respective one of said ends of said spacer elements, each spacer being positioned between a respective pair of immediately adjacent tubes within a circular row of said array, said tabs of each said spacer element being inserted into the slots in locations defined by said immediately adjacent tubes so as to fix the position of each said spacer element between the respective immediately adjacent rings, said spacers thereby providing support to and spacing said tubes within said circular array.

9. A spacer for spacing and supporting tubes within a tube support grid comprising: sheet metal formed to have opposing concave sides to conform to adjacent tubes, the outer surface of the concave sides having a radius of curvature approximately equal to that of the outer surface of the tubes, and two V-shaped ends pointed away from one another, each of said ends connecting to both of said concave sides.

10. A spacer for spacing and supporting tubes having a common diameter, said tubes being arranged in a circular array with a predetermined circumferential pitch within a tube support grid, said tube support grid including a series of concentric rings, comprising: sheet metal formed to have opposing concave sides and two V-shaped ends pointed away from one another, each of said ends connecting to both of said concave sides, the outer surface of each of said concave sides having a radius of curvature approximately equal to that of the outer surface of the tubes, the distance of closest approach of said concave sides of each spacer being approximately equal to the difference between said predetermined circumferential pitch and the diameter of said tubes.

11. The spacer of claim 9 or 10 further comprising one outwardly directed tab on each of said ends.

12. The spacer of claim 9 or 10 further characterized in that each of said concave sides subtends approximately one-fourth of a circle.

* * * * *

UNITED STATES PATENT AND TRADEMARK OFFICE

CERTIFICATE OF CORRECTION

PATENT NO. : 4,570,703

DATED : February 18, 1986

INVENTOR(S) : Ringsmuth et al.

It is certified that error appears in the above-identified patent and that said Letters Patent is hereby corrected as shown below:

Col. 2, line 48: Change "an" to read --a--.

Col. 2, line 50: After "portion" insert --of--.

Col. 3, line 2: Change "tubesheet" to read --tube sheet--.

Col. 6, line 7: Change "a" (second occurrence) to --at--.

Col. 6, line 20: Change "coefficent" to read --coefficient--.

Col. 6, line 31: Change "coefficent" to read --coefficient--.

Col. 7, line 18: Change "$R_{t\ell}$" to read --$R_{t1}$-- (numeral one rather than letter ell).

Col. 7, line 49: Change ";" to --.-- (period).

Col. 10, line 32: After "exchanger" insert --are--.

Col. 13, line 7: After "pitches" insert --,-- (comma).

Signed and Sealed this

Eighth Day of July 1986

[SEAL]

Attest:

DONALD J. QUIGG

Attesting Officer

Commissioner of Patents and Trademarks